US009446881B2

(12) United States Patent
Jung

(10) Patent No.: US 9,446,881 B2
(45) Date of Patent: Sep. 20, 2016

(54) BOTTLE

(75) Inventor: Kyung Il Jung, Seoul (KR)
(73) Assignee: Jonathan Lee, Warner Robins, GA (US)

( * ) Notice: Subject to any disclaimer, the term of this patent is extended or adjusted under 35 U.S.C. 154(b) by 1398 days.

(21) Appl. No.: 12/741,869
(22) PCT Filed: Dec. 9, 2008
(86) PCT No.: PCT/KR2008/007261
§ 371 (c)(1),
(2), (4) Date: May 7, 2010
(87) PCT Pub. No.: WO2010/064749
PCT Pub. Date: Jun. 10, 2010

(65) Prior Publication Data

US 2010/0270260 A1 Oct. 28, 2010

(30) Foreign Application Priority Data

Dec. 5, 2008 (KR) ..... 10-2008-0123344

(51) Int. Cl.
*B65D 23/04* (2006.01)
*B65D 1/02* (2006.01)

(52) U.S. Cl.
CPC ..... *B65D 23/04* (2013.01); *B65D 1/0292* (2013.01); *B65D 2501/0018* (2013.01)

(58) Field of Classification Search
CPC ..... B65D 1/0223; B65D 2501/0081; B65D 2501/0036; B65D 1/0292; B65D 79/005
USPC ..... 215/382, 379, 384, 40, 46; 220/669, 220/666, 673, 675, 288, 104, 473, 92; D9/516, 527, 550
See application file for complete search history.

(56) References Cited

U.S. PATENT DOCUMENTS 2,723,779 A * 11/1955 Parker ..... B65D 35/10 215/2
3,946,903 A * 3/1976 Parker ..... B29C 49/48 215/900
D406,065 S * 2/1999 Cheng ..... D9/434
6,662,964 B2 * 12/2003 Higuchi ..... B65D 1/0292 215/11.3
6,666,001 B2 * 12/2003 Mero ..... B65D 1/0223 215/381
6,736,285 B2 * 5/2004 Stewart-Stand ..... A45F 3/20 206/218
RE38,770 E * 8/2005 Gilbert ..... B65D 23/00 215/382
7,228,981 B2 * 6/2007 Chisholm ..... B65D 1/0223 215/379
2004/0069740 A1 * 4/2004 Athalye ..... B65D 1/0292 215/381
2006/0108318 A1 * 5/2006 Chisholm ..... B65D 1/0223 215/382
2006/0207961 A1 * 9/2006 Kurtz ..... B65D 1/0223 215/382
2007/0068894 A1 * 3/2007 Iwashita ..... B65D 1/0223 215/382
2010/0072167 A1 * 3/2010 Dickie ..... B65D 1/0292 215/382
2010/0140294 A1 * 6/2010 Bourguignon ..... B65D 83/0094 220/666
2010/0219189 A1 * 9/2010 Buttigieg ..... B65D 1/0292 220/288

FOREIGN PATENT DOCUMENTS

JP 2007-8536 1/2007
KR 2020010027665 12/2001

* cited by examiner

*Primary Examiner* — Fenn Mathew
*Assistant Examiner* — Cynthia Collado
(74) *Attorney, Agent, or Firm* — Pillsbury Winthrop Shaw Pittman LLP

(57) ABSTRACT

Disclosed is a bottle for containing liquid contents including a body, at least part or all of an upper portion of which is provided with a plurality of guides which protrude inwardly from an inside surface thereof and are in a spiral pattern so that the liquid contents can be guided towards an opening of a neck of the bottle while spirally revolving inside the bottle.

2 Claims, 7 Drawing Sheets

100

BOTTLE

TECHNICAL FIELD

The present invention relates to a bottle for containing liquid contents therein, and more particularly to a bottle which can stably discharge liquid contents through an opening by making the contained liquid contents smoothly flow along a plurality of guides arranged in a spiral pattern.

BACKGROUND ART

At present, beverages, such as water and colas, liquors, or liquid-type food, are contained in various kinds of containers. Examples of such liquid containers are paper bottles, PET bottles, glass bottles, and metal bottles (aluminum cans).

Of these containers, the PET bottle is the most popular liquid container thanks to its many advantages, such as that it can contain contents for a relatively long time, i.e. contents in the PET bottle barely decay after a long time of storage because gas transmittance of the PET bottle is very low compared with other kinds of containers, it hardly breaks when it is dropped in a state in which it is filled with contents, it does not produce broken pieces even when it is ruptured, and it is convenient to carry and keep the PET bottle because the PET bottle is lighter than a glass bottle.

The known PET bottle having the above advantages is generally composed of a neck which has an opening at an end and threads on an outer surface thereof for sealing when the neck is combined with a cover, and a body extending from the neck and containing contents therein. The body may be of various sizes and forms according to the type of contents.

There are ways of discharging the contents of the PET bottle. For example, when a user tilts the PET bottle to pour the contents into a vessel, such as a cup, or to directly drink the contents from the PET bottle, the contents are discharged from the PET bottle.

In such a case, there is a possibility that the contents contained in the body of the PET bottle are not smoothly discharged but are abruptly discharged at excessive pressure, so that the contents are likely to gush out of the PET bottle and to splatter on a user's clothes or the surrounding area.

In particular, when the user directly drinks the contents from the bottle, the user may choke or his or her clothes or body may get splashed.

Further, since the bottles have large volumes even when they are empty, it is difficult to deal with the empty bottles or it is required to install additional equipment in households to reduce the volume of the empty bottles.

SUMMARY

In order to accomplish the above and other advantages, there is provided a bottle for containing liquid contents including a body. At least part or all of an upper portion of the body is provided with a plurality of guides. The upper portion is on the upper side of the middle of the body in a longitudinal or vertical direction of the upright bottle. The guides have a convex shape or protrude inwardly from an inside surface of the body in a spiral pattern so that the liquid contents can be guided toward an opening of a neck of the bottle while spirally revolving inside the bottle.

It is preferable that the entire body of the bottle be provided with the plurality of guides which protrude inwardly from the inside surface of the bottle in a spiral pattern.

It is preferable that a cross-section of each of the plurality of guides has a curvature or shape of the letter "C" or a reversed letter "C" when each guide is cut vertically by a plane through a central axis or width of the upright bottle, and the curvature of each guide cross-section is (a) uniform over a portion of its length or (b) changes in a manner such that (i) a curve of a trailing portion is relatively gentle, where trailing is relative to liquid contents flowing over the guide directly out of the bottle as shown by arrows in enlarged cross-sectional view of FIG. 6 and which portion is on the side of the curvature towards the opening of bottle as shown by example with reference letter a in enlarged cross-sectional view in FIG. 6 and (ii) a curve of a leading, liquid-first-contacting or back portion is relatively tight, where leading and liquid-first-contacting is again relative to liquid contents flowing directly out of the bottle as shown by arrows in enlarged cross-sectional view of FIG. 6 and which portion is on the side of the curvature towards the back of bottle as shown by example with reference letter b in enlarged cross-sectional view in FIG. 6.

It is preferable that the plurality of guides be four or eight lines in spiral patterns.

It is preferable that the bottle be a paper bottle, a PET bottle, a metal bottle, or a glass bottle.

It is preferable that each of the plurality of guides takes a form in which a width of the guide at a lower area is larger than the width of the guide at an upper area. The upper and lower areas are with respect to the bottle standing upright.

It is preferable that each of the plurality of guides has a uniform width at the upper part and the lower part.

As described above, according to an embodiment of the invention, the bottle is provided with a plurality of guides having a spiral pattern winding around the body of the bottle so that liquid contents in the bottle can be stably guided toward and discharged through the opening of the bottle while spirally revolving inside the bottle. Since the abrupt gushing of the liquid contents is prevented, it is possible to safely pour and deliver the liquid contents from the bottle and prevent splattering of the liquid contents, attributable to the abrupt discharge of the liquid contents, from occurring.

In the case in which the bottle is used to contain a beverage, such as water, cola, or juice, since the flow of the beverage is moderate, it is possible to prevent accidents such as the user choking.

In the case in which the bottle is a PET bottle, it is possible to reduce the volume of the empty bottle by applying external force to the empty bottle after the contents have been emptied so that the bottle is twisted as the plurality of guides is compressed. Accordingly, it is easy to dispose of and recover the empty bottles.

It is an advantage of some aspects of the invention that a bottle is provided with a body provided with a plurality of guides arranged in a spiral pattern so that liquid contents can be smoothly and stably discharged through an opening of the bottle, while spirally revolving inside the bottle.

It is another advantage of some aspects of the invention to provide a bottle which can prevent liquid contents from gushing out of the bottle so that a user can safely pour or drink the liquid contents, and it is possible to prevent contamination, attributable to a violent gushing of the liquid contents, from occurring.

It is a further advantage of some aspects of the invention to provide a bottle provided with a body which can be easily twisted by external force when all of the contents have been emptied, so that the volume of the bottle is maximally reduced.

DESCRIPTION OF DRAWINGS

The above and other objects, features and advantages of embodiments of the present invention will be more clearly understood from the following detailed description when taken in conjunction with the accompanying drawings.

DETAILED DESCRIPTION

Figure 1:
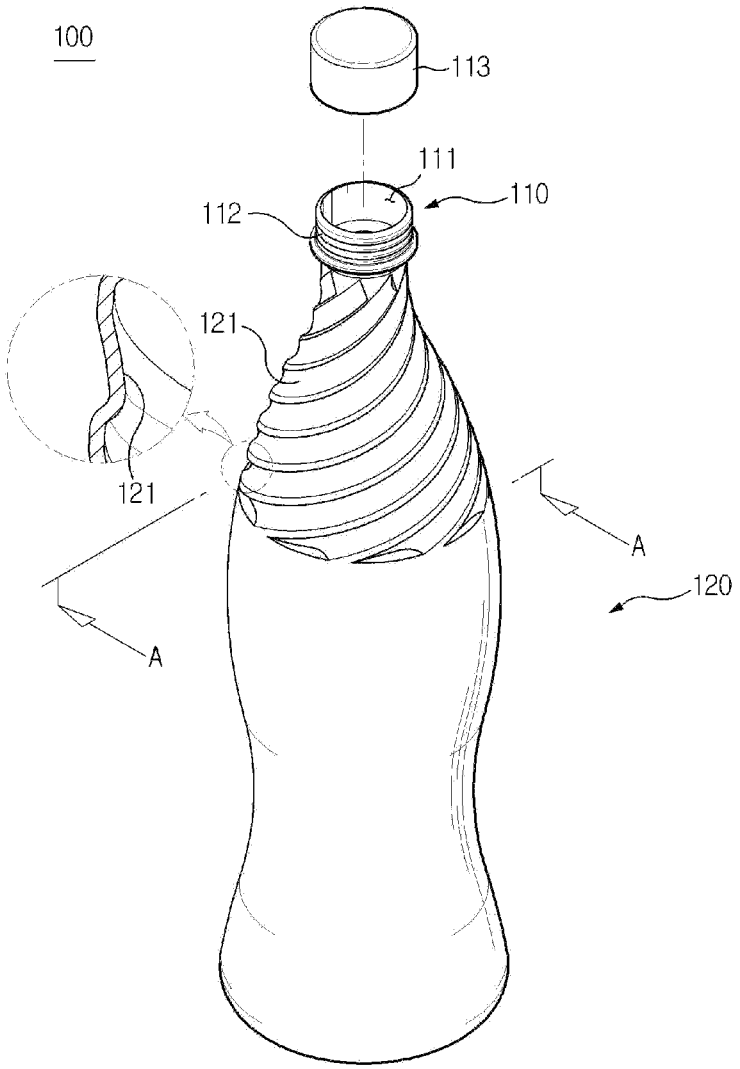
FIG. 1 is a perspective view illustrating a bottle according to one embodiment of the invention and an enlarged, vertical, cross-sectional view of a guide of the bottle.

Reference will now be made in greater detail to exemplary embodiments of the invention, an example of which is illustrated in the accompanying drawings. Wherever possible, the same reference numerals will be used throughout the drawings and the description to refer to the same or like parts.

Hereinafter, embodiments of the invention will be described with reference to the accompanying drawings through which like elements are referenced by like numbers. In describing the invention, details on the structure or function of related arts are omitted if they may obscure the subject of the invention.

Terms in the description are defined considering functions of elements of the invention, so that the terms must be construed with reference to the contents of the present specification as a whole because such terms can be differently defined according to the intents of people skilled in their arts or customs.

FIG. 1 is a perspective view illustrating a bottle according to one embodiment of the invention. FIGS. 2A and 2B are cross-sectional views illustrating a cross-section of the bottle taken along line A-A of FIG. 1. FIG. 3 is a perspective view illustrating a bottle according to another embodiment of the invention, and FIGS. 4A and 4B are cross-sectional views illustrating a cross-section of the bottle taken along line B-B.

Figure 2:
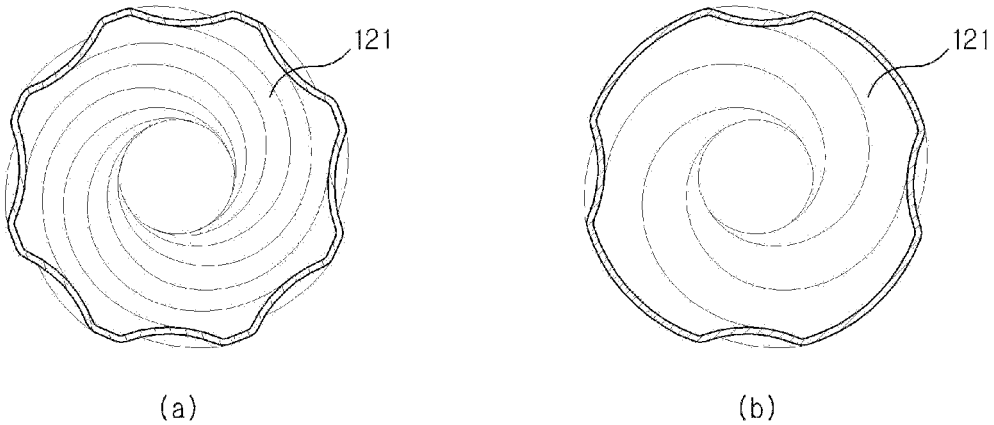
FIGS. 2A and 2B are cross-sectional views taken along line A-A of FIG. 1.
Figure 3:
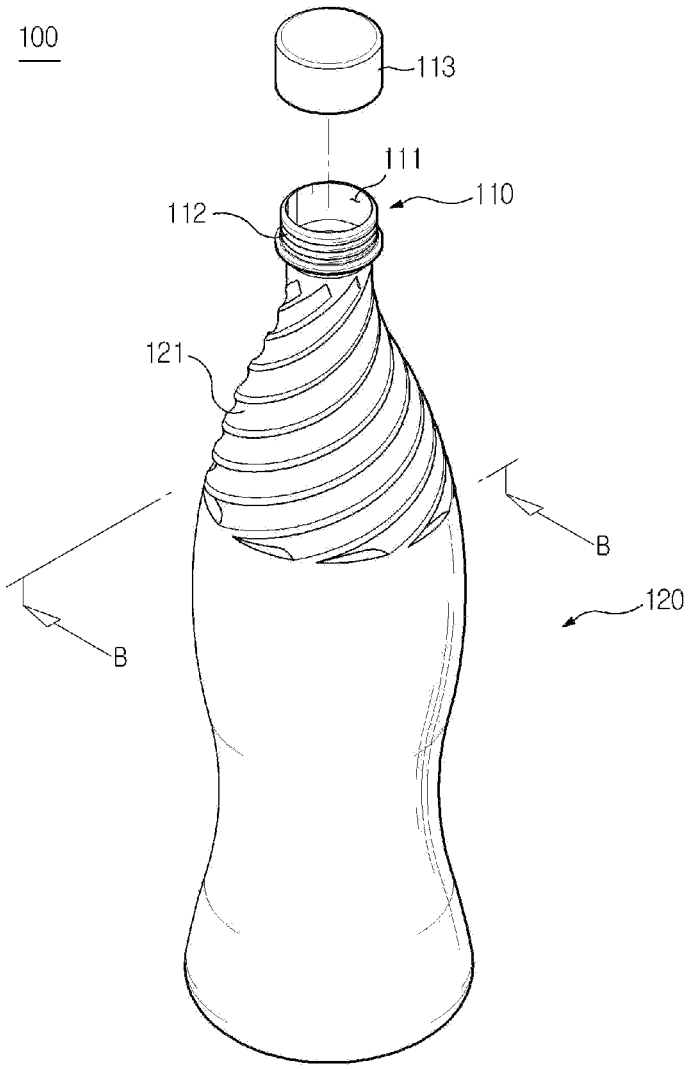
FIG. 3 is a perspective view illustrating a bottle according to another embodiment of the invention.
Figure 4:
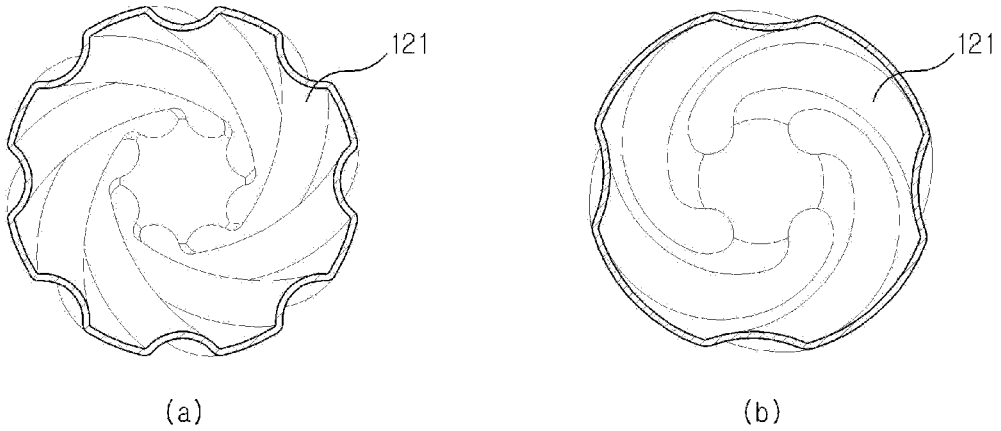
FIGS. 4A and 4B are cross-sectional views taken along line B-B of FIG. 3.

As shown in FIGS. 1 to 3, the bottle of embodiments of the invention includes a neck 110 and a body 120.

The neck 110 has an opening 111 and a thread 112 to be combined with a cover 113 in a screwed manner. Alternatively, the neck may be combined with the cover 113 in manners different from the screwed manner for ensuring sealing of the bottle. For example, the cover 113 can be attached to or detached from the neck 110.

The body 120 extends from the neck 110 and contains liquid contents therein.

The bottle 100 having the above-mentioned structure can contain a beverage, such as water or cola, a liquor, a saline solution, or a liquid-type food, and may be made of various materials.

The bottle 100 may be a paper bottle, a PET bottle, a metal bottle, or a glass bottle.

Hereinafter, one of the preferred embodiments of the invention, a polyethylene terephthalate resin (PET) bottle, will be explained.

As shown in FIGS. 1 to 3, the body 120 takes a form in which a plurality of guides 121 is provided in a spiral pattern. The guides protrude inwardly from the inside surface of the entire or part of an upper portion of the body 120 which is on the upper side of the middle of the body 120 in a length direction so that the liquid contents proceed toward the opening 111 of the neck 110 while spirally revolving inside the bottle 100 and are then discharged out of the bottle 100.

With such a structure, the outer surface of the body 120 with the plurality of guides 121 is depressed in a concave form corresponding to the plurality of guides 121 in the convex form.

As the plurality of guides 121 is provided to the upper portion of the body 120 in the spiral pattern, the body 120 is wavelike in appearance.

Figure 6:
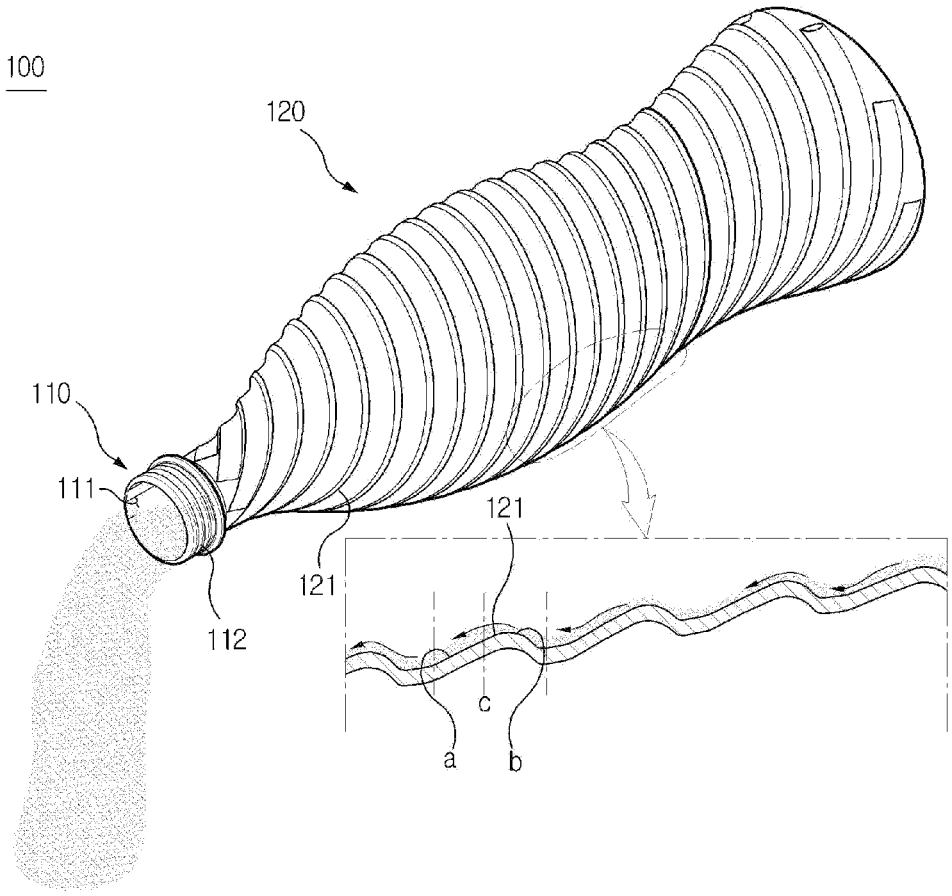
FIG. 6 is a perspective view and an enlarged, lengthwise, cross-sectional view for explaining a curvature of a cross-section of a guide of the bottle.

Further, a cross-sectional view of the body 120 shows that each of the plurality of guides 121 has a curvature in the shape of a letter "C" or a reversed letter "C". When the cross-section of the body 120 is viewed in the direction in which contents proceed out of the bottle (see arrows in enlarged cross-sectional view in FIG. 6), the curve of a trailing portion of the curvature, which is on the side of the curvature towards the opening of the bottle as shown by example with reference letter a in enlarged cross-sectional view in FIG. 6, is relatively loose, but the curve of a leading, liquid-first-contacting or back portion of the curvature, which is on the side of the curvature towards the back of the bottle as shown by example with reference letter b in enlarged cross-sectional view in FIG. 6, is relatively tight.

Alternatively, the body may take a form in which the curvature is maintained constant.

When the liquid flows in the above-mentioned manner, the curvature of a portion with which the liquid makes earlier contact must be relatively tight and the curvature of a portion to which the liquid contacts later must be relatively loose. The portion having the relatively tight curvature hinders the flow of the liquid primarily and then the portion having the relatively loose curvature makes the flow of the liquid slower. The border between the portion with the relatively tight curvature and the portion with the relatively loose curvature takes a streamlined shape so that the friction with the liquid is reduced.

In the case in which the curvature is constant at every portion, it is also possible to attain the same advantage of controlling the speed of flow of the liquid in the above-mentioned manner.

It is preferable that the plurality of guides 121 take a form composed of four or eight spiral lines, but the form is not limited thereto. That is, the form may be composed of other than eight spiral lines.

Further, the widths of the plurality of guides 121 are narrower at a relatively upper area and broader at a relatively lower area of the body of the bottle relative to it standing upright.

The widths of the plurality of guides 121 gradually decrease toward the upper area and increase toward the lower area, but do not change from a midpoint to the bottom of the body in length.

Alternatively, the widths of the guides 121 may be uniform over their lengths.

FIG. 1 shows the PET bottle 10 having the above-described structure. In FIG. 1, the widths of the plurality of guides 121 in a spiral pattern are uniform over their lengths. FIGS. 2A and 2B are plan views of the upper part of the body of the PET bottle 100, which are taken along A-A of FIG. 1 and viewed from the bottom side toward the opening of the bottle.

FIG. 2A shows the case in which the number of guides of the plurality of guides 121 is eight, and FIG. 2B shows the case in which the number of guides of the plurality of guides 121 is four.

FIG. 3 shows the PET bottle 100 having a form in which the widths of the plurality of guides 121 decrease toward the upper end or area but gradually increase toward a lower area or general middle point of the bottle. From the general middle point towards the bottom of the body of the bottle, the widths are optionally uniform.

FIGS. 4A and 4B are plan views taken along line B-B of FIG. 3 and viewed from the bottom side of the PET bottle 100 toward the opening.

FIG. 4A shows the case in which the number of guides of the plurality of guides 121 is eight and FIG. 4B shows the case in which the number of guides of the plurality of guides 121 is four.

Figure 5:
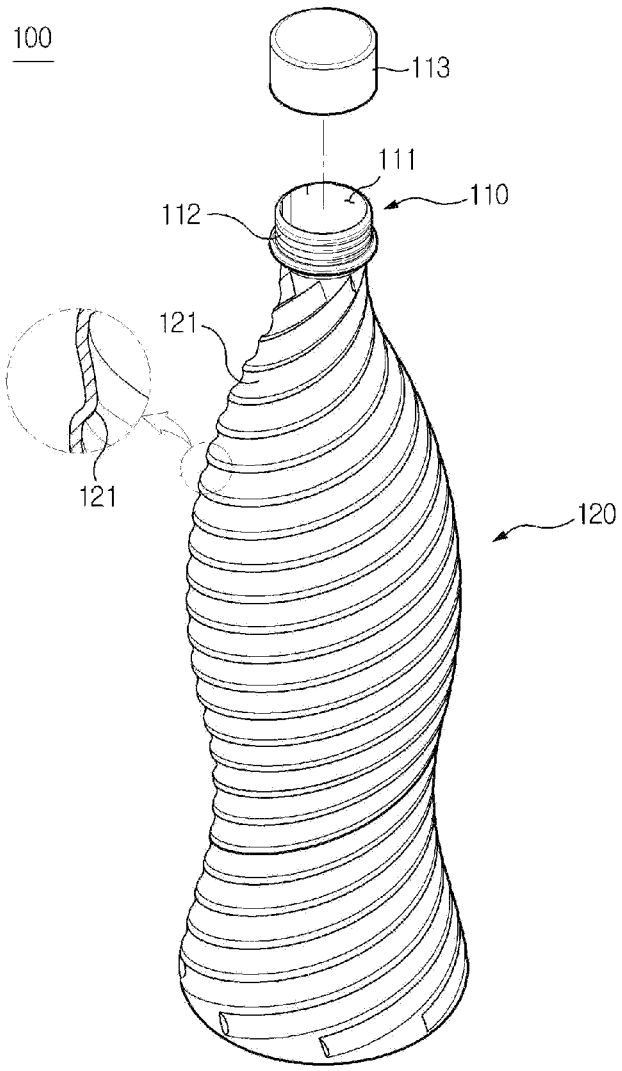
FIG. 5 is a perspective view illustrating a bottle according to a further embodiment of the invention and an enlarged, vertical, cross-sectional view of a guide of the bottle.

FIG. 5 is a perspective view illustrating a PET bottle according to another embodiment of the invention.

As shown in FIG. 5, the PET bottle 100 according to this embodiment of the invention basically is similar in form and function to the PET bottle shown through FIGS. 1 to 4B. Accordingly, repetitive description will be omitted and only the differences therebetween will be described.

As shown in FIG. 5, the entire body 120 of the PET bottle 100 has a plurality of guides 121 protruding inward from the inside surface of the body and making a spiral pattern.

Accordingly, the entire body 120 is wavelike in appearance.

FIG. 6 is a perspective view and a section-enlarged view illustrating the PET bottle 100 for explaining the curvature of the guide 121 provided to the PET bottle 100.

As shown in FIG. 6, when tilting and pouring the liquid contents, for example cola, in the PET bottle 100, the liquid contents flow over the plurality of guides 121 inside the PET bottle 100 (see enlarged cross-sectional view in FIG. 6) and therefore the liquid contents are discharged with uniform flow through the opening 111.

As shown in FIG. 6, a curvature of a portion (b) of each guide 121 which is on the leading, liquid-first-contacting, or towards-the-bottom-of-the-bottle side of a midpoint (c) in the direction of the liquid contents flowing directly towards the opening of the bottle, is tighter than a curvature of a portion (a) which is on the trailing or towards-the-opening-of-the-bottle side of the center (c). That is, the portion (a) has a gentle curve or relatively long radius of curvature and the portion (b) has a tight curve or relatively short radius of curvature. As a result, this form prevents the liquid from being abruptly discharged.

Figure 7:
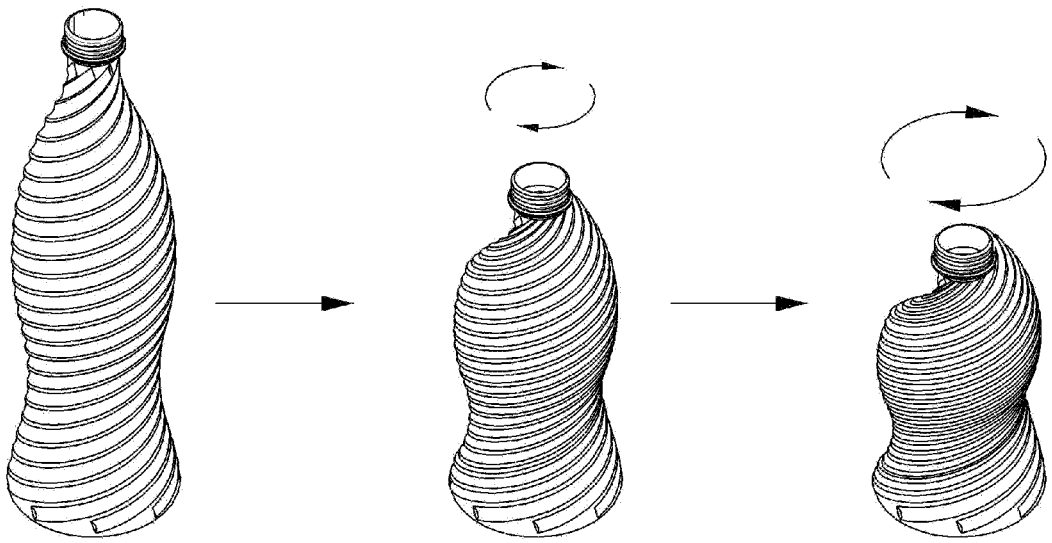
FIG. 7 is a comparative view illustrating a procedure of disposing of the bottle according to embodiments of the invention.

FIG. 7 is a comparative view for illustrating a procedure of disposing of the PET bottle according to the embodiment of the invention.

The PET bottle 100 is crushed and distorted by twisting and compressing along the plurality of guides 121 formed in the body 120 of the PET bottle 100. When a compressing force is applied to the PET bottle 100, the middle point or a border between the large-radius-of-curvature portion (a) and the small-radius-of-curvature-curvature portion (b) of each guide 121 having the letter "C" shape or the reversed letter "C" shape is folded over a portion of the length of the spiral pattern, so it is possible to reduce the volume of empty bottles.

For this reason, it is possible to make recovering empty bottles easier.

Although the bottle of the invention has been described in terms of preferred embodiments, it will be apparent to those skilled in the art that various modifications and variations may be made without departing from the spirit of the invention. Thus, the scope of the invention must be defined by the appended claims and it is intended that the present invention covers modifications and variations of this invention.

The invention claimed is:

1. A bottle for containing liquid contents, comprising:

a body, at least part of an upper portion of which is provided with a plurality of guides each of which protrude inwardly from an inside surface of the body and extends continuously between a lower end and an upper end of the upper portion in a spiral pattern; and a neck having an opening therein, wherein a cross-section of each of the plurality of guides has a curvature in the general shape of a letter "C" or a reversed letter "C" when each of the plurality of guides is cut by a plane through a central axis of the spiral pattern, and wherein each of the curvatures changes in a manner such that, in a liquid flow direction from the body directly towards the opening, a leading portion of the curvature is relatively tight and a trailing portion of the curvature is relatively loose.

2. The bottle according to claim 1, wherein the bottle is a paper bottle, a PET bottle, a metal bottle, or a glass bottle.

* * * * *